United States Patent [19]

Spencer et al.

[11] 4,360,756

[45] Nov. 23, 1982

[54] METAL HALIDE LAMP CONTAINING $THI_4$ WITH ADDED ELEMENTAL CADMIUM OR ZINC

[75] Inventors: John E. Spencer, South Euclid; Ashok K. Bhattacharya, Lyndhurst, both of Ohio

[73] Assignee: General Electric Company, Schenectady, N.Y.

[21] Appl. No.: 93,899

[22] Filed: Nov. 13, 1979

[51] Int. Cl.[3] ..... H01J 17/20; H01J 61/22

[52] U.S. Cl. ..... 313/179; 313/229; 313/228

[58] Field of Search ..... 313/179, 229

[56] References Cited

U.S. PATENT DOCUMENTS

| | | | |
|---|---|---|---|
| 3,234,421 | 2/1966 | Reiling | 313/229 X |
| 3,313,974 | 4/1967 | Koury et al. | 313/218 |
| 3,398,312 | 8/1968 | Edris et al. | 313/225 |
| 3,521,110 | 7/1970 | Johnson | 313/227 |
| 3,700,960 | 10/1972 | Lake | 313/229 X |
| 3,740,605 | 6/1973 | Divoix et al. | 313/229 |
| 3,845,342 | 10/1974 | Waymouth et al. | 313/229 X |
| 3,886,391 | 5/1975 | Koury et al. | 313/218 |
| 4,171,498 | 10/1979 | Fromm et al. | 313/229 |

FOREIGN PATENT DOCUMENTS

| | | | |
|---|---|---|---|
| 2546417 | 7/1976 | Fed. Rep. of Germany | 313/229 |

*Primary Examiner*—Robert Segal

*Attorney, Agent, or Firm*—Ernest W. Legree; Lawrence R. Kempton; Philip L. Schlamp

[57] ABSTRACT

In a high intensity metal halide discharge lamp utilizing thorium in conjunction with a transport cycle for electrode activation, a getter, preferably cadmium or zinc is added to the lamp fill for the purpose of reducing the concentration of free iodine during operation. By so doing, deposition of thorium on the electrode tip during operation is assured and performance and maintenance are improved. The quantity of getter may include a portion supplied as a corrective measure to scavenge excess iodine released during manufacture, and another portion providing a long-term buffering capacity for capturing iodine released during the lamp's life by reaction of the dose, particularly $ScI_3$ and $ThI_4$, with the $SiO_2$ of the lamp envelope.

1 Claim, 3 Drawing Figures

METAL HALIDE LAMP CONTAINING $THI_4$ WITH ADDED ELEMENTAL CADMIUM OR ZINC

The invention relates to high intensity discharge lamps of the metal halide type in which the fill comprises mercury and light-emitting metals in the form of halides, and which utilize a metal of lower work function than tungsten such as thorium, in conjunction with a transport cycle, for electrode activation; it is particularly useful with lamps containing sodium, scandium and thorium iodide.

BACKGROUND OF THE INVENTION

Metal halide lamps began with the addition to the high pressure mercury lamp of the halides of various light-emitting metals in order to modify its color and raise its operating efficacy as proposed by U.S. Pat. No. 3,234,421—Reiling, issued in 1966. Since then metal halide lamps have become commercially useful for general illumination; their construction and mode of operation are described in IES Lighting Handbook, 5th Edition, 1972, published by the Illuminating Engineering Society, pages 8–34.

The light-emitting metals favored by Reiling for addition to the arc tube fill were sodium, thallium and indium in the form of iodides. This combination had the advantage of giving a lamp starting voltage almost as low as that of a mercury vapor lamp, thus permitting interchangeability of metal halide with mercury lamps in the same sockets. A later U.S. Pat. No. 3,407,327—Koury et al issued in 1968, proposed as additive metals sodium, scandium and thorium; that fill is now favored because it produces light of somewhat better spectral quality. Unfortunately, it also entails a higher starting voltage so that the lamp is not generally interchangeable with mercury vapor lamps.

In the earlier thallium-containing metal halide lamps, the electrodes used comprised tungsten coils carrying thorium oxide in the turns. In operation, the thorium oxide is believed to decompose slightly and release free thorium to supply a monolayer film having reduced work function and higher emission. Unfortunately, this cathode cannot be used in a scandium-containing lamp because the $ScI_3$ is converted to $Sc_2O_3$, resulting in loss of essentially all the scandium in a relatively short time. Instead a thorium-tungsten electrode is used which is formed by operating a tungsten cathode, generally a tungsten rod having a tungsten coil wrapped around it to serve as a heat radiator, in a thorium iodide-containing atmosphere. Under proper conditions the rod acquires a thorium spot on its distal end which serves as a good electron emitter and which is continually renewed by a transport cycle involving the halogen present which returns to the cathode any thorium lost by any process. The thorium-tungsten electrode and its method of operation are described in Electric Discharge Lamps by John F. Waymouth, M.I.T. Press, 1971, Chapter 9.

We find that the proper operation of the thorium transport cycle is suppressed when excess iodine is present. In a cool lamp at room temperature the excess iodine is present as $HgI_2$. When the lamp operates, this mercury iodide decomposes and the free iodine reacts with the thorium at the electrode. The thorium concentration at the electrode tip is governed by the equilibrium expression:

$$Th(c)+4I(g)\rightleftharpoons ThI_4(g)$$

In the presence of high iodine concentrations, the forward reaction favoring the formation of $ThI_4$ predominates. At sufficiently high iodine concentrations, no thorium is deposited on the electrode at all, and the result is a high work function electrode. The electrode must then run hotter to sustain the arc current and this entails lower efficiency most noticeable in the smaller sizes of lamps. The higher temperature makes the lamp blacken due to tungsten evaporation and the result is a poor maintenance lamp.

In one manufacturing process, the lamps are dosed with mercury as liquid and with the iodides of Na, Sc, and Th in pellet form. In this process, it is practically unavoidable that some hydrolysis reaction occurs due to absorption of moisture from the atmosphere by the pellets in transferring them to the lamp envelope. The metal halide dose comprising NaI, $ScI_3$ and $ThI_4$ is extremely hygroscopic and even very low levels of moisture will result in some hydrolysis. The hydrolysis results in conversion of the metal halide to oxide with release of HI, for example:

$$2ScI_3+3H_2O\rightarrow Sc_2O_3+6HI$$

The HI reacts with mercury to form $HgI_2$ which is relatively unstable at high temperatures, and when the lamp warms up, the $HgI_2$ decomposes and releases free iodine. Some excess iodine also is frequently found in the dosing materials, possibly as a byproduct of the synthesis of these materials. The result is a lamp which frequently contains excess iodine from the start.

In another manufacturing process, part of the mercury and the halogen component of the charge are introduced into the lamp envelope in the form of $HgI_2$ and scandium and thorium are added as elements. By varying the ratio of Hg to $HgI_2$, the iodine may be made substoichiometric relative to the Sc or Th present, in which case the lamp begins its life with no excess iodine. However we have found that a slow reaction between the scandium and thorium iodides and the fused silica arc tube gradually frees iodine during the course of the lamp's life. As the free iodine concentration builds up, a point is reached where thorium ceases to be deposited on the electrode at all and the result is a high work function electrode.

Thus prior art lamps, no matter by what process made and even when they begin life without an excess of iodine, eventually arrive at a condition of excess iodine concentration which reduces lamp efficacy and results in an increased rate of blackening and lumen depreciation. The object of the invention therefore is to provide control of excess iodine throughout the full period of the lamp's life in order that the lamp have higher efficiency, better maintenance and a longer useful life.

SUMMARY OF THE INVENTION

In accordance with our invention we provide as getters in a thorium containing metal halide discharge lamp one or more of the metals Cu, Ag, In, Pb, Cd, Zn, Mn, Sn and Tl or mixtures thereof. These may be usefully added to the lamp fill for the purpose of reducing the concentration of free iodine in the lamp atmosphere during operation. By so doing, deposition of thorium on the electrode tip during operation is assured and performance and maintenance of the lamp are thereby improved.

Of the foregoing elements, cadmium and zinc are preferred as getters because of the ease with which they may be added to the lamp fill and because any change in spectral output which they cause is in the desirable direction of a lower color temperature. The quantity of getter which it is desirable to add will depend in part upon the process by which the lamp was manufactured, as will be explained in detail hereafter.

DETAILED DESCRIPTION

Our invention is predicated on the concept of adding a getter for excess halogen to the dose and such getter in order to be successful must meet certain criteria.

Criteria For Successful Getter

Figure 1:
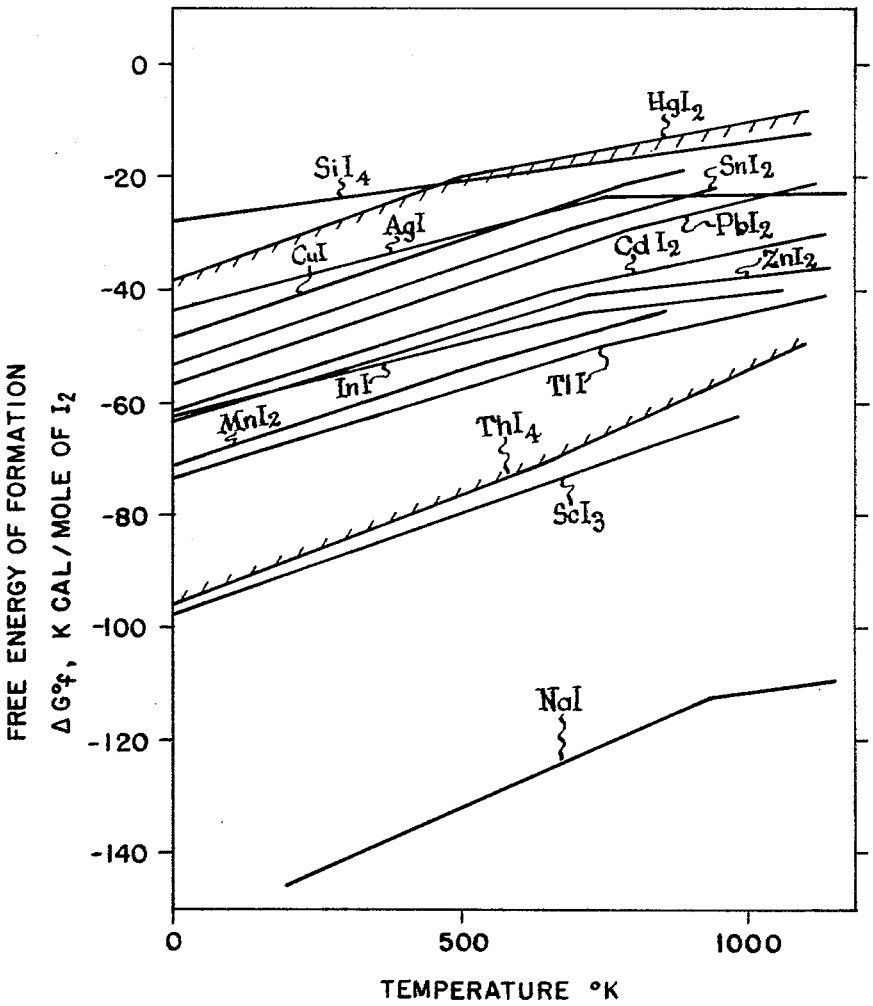
FIG. 1 is a graph showing the free energies of formation of several metal iodides.

1. The getter must effectively reduce the pressure of free halogen at the electrode in the operating lamp. Where iodine is the halogen utilized, the only metals that can do this are those which form iodides of greater stability than $HgI_2$ and which therefore prevent the formation of $HgI_2$. Furthermore, in order to prevent any undesirable changes in the chemistry of the lamp dose, the getter must form iodides of less stability than the principal light-emitting metals contained in the lamp, for instance sodium, scandium and thorium. In thermodynamic terms, the free energy of formation of the getter iodide compound must be more negative than that of $HgI_2$, but less negative than that of $ThI_4$ which is the least negative component of the fill. FIG. 1 shows selected metals which successfully meet these criteria; the free energy of formation of their iodides fall in the cross-hatched region between $HgI_2$ and $ThI_4$ over the operating temperature range of the lamp. The metals are Cu, Ag, In, Pb, Cd, Zn, Mn, Sn and Tl. If the lamp fill utilized halides other than iodides, for instance bromides, the relative stabilities would in general not change so that the same selection of getters is available.

2. The getter must not react with $SiO_2$ of which the quartz or fused silica arc tube is composed. Prior art attempts to resolve the excess iodine problem by adding excess scandium or thorium relative to iodine in the lamp fill have been successful initially. However, eventually the attempt fails and we have found the reason to be that the excess scandium or thorium is relatively rapidly removed by reaction with the fused silica. Our invention avoids this by providing a getter metal that does not react with fused silica; this assures control of iodine throughout the life of the lamp.

In lamps according to our invention there remains, as in the prior art, a slow reaction of $ThI_4$ and $ScI_3$ with $SiO_2$ of the arc tube, thereby freeing iodine and silica. In the prior art the excess scandium or thorium present could react with the freed iodine initially. But as previously mentioned, scandium and thorium are relatively rapidly depleted. After such depletion, the silicon reacts with excess iodine and forms $SiI_4$. The presence of silicon tetra-iodide gives rise to a transport cycle depositing silicon on the electrode as a molten film in which tungsten apparently dissolves slightly by forming tungsten silicide. The solution of tungsten into a silicon film can make drastic changes in electrode geometry (as pointed out by Waymouth loc cit p. 249), and the process as a whole causes lamp deterioration. The thermodynamic stability of $SiI_4$ is similar to that of $HgI_2$, and both compounds can coexist in a lamp containing excess iodine. A getter in accordance with the invention will prevent the formation of $SiI_4$ and thereby suppress silicon transport, in addition to preventing the formation of $HgI_2$. The metals previously listed under criterion 1 were selected to also satisfy this criterion.

Preferred Getters

Of the previously listed metals which are suitable as getters by the criteria which we have established, we prefer cadmium or alternatively zinc for the following reasons.

The getter metal, whether present as metal or as metal iodide, will exercise some vapor pressure in the discharge space and participate in the discharge, generating its own spectral lines. Cd and Zn have strong lines in the red, and the effect which they have on the spectrum if any is to shift it towards a lower color temperature. Thus if the getter causes a change in the spectral output, it is in a desirable direction. It should be noted however that Cd or Zn are not as efficacious spectral emitters as the Na, Sc and Th combination, and adding a great excess over what is needed for the gettering function would reduce the overall efficacy of the lamp.

The getters Cd and Zn are both soluble in mercury to an extent which is fully adequate to supply the amount needed for the gettering function by dissolving them in the lamp's mercury charge. Thus no change in lamp processing is needed, and the getter need only be dissolved in the mercury with which the lamp is normally dosed in order to use the invention in factory production.

Quantity of Getter

The quantity of getter which should be supplied will vary with the process used in making the lamp. Depending on the process, some getter may be required as a corrective measure, and irrespective of the process, some getter is desirable as a buffering measure. Where hygroscopic material such as $ScI_3$ or $ThI_4$ is dosed into the lamp, getter should be supplied as a corrective measure to scavenge any iodine released as a result of moisture pickup in manufacturing the lamp. If the thorium content of the lamp fill is provided as $ThI_4$ (rather than as thorium metal) again, getter should be supplied as a corrective measure to scavenge the iodine resulting from the decomposition of $ThI_4$ necessary to permit deposition of thorium metal on the electrode. Over and above the foregoing, our invention calls for supplying some getter in order to have a long-term buffering capacity for capturing iodine released during the lamp's life as a result of reaction of the dose, in particular $ScI_3$ and $ThI_4$, with the $SiO_2$ of the lamp envelope.

In the first process previously mentioned in which the dose comprises liquid memory and the iodides of Na, Sc and Th in pellet form, we propose first to supply enough getter to scavenge any iodine released in the lamp as a result of impurities picked up during manufacturing or processing, plus the iodine resulting from the decomposition of $ThI_4$ which must take place in order to have deposition of Th metal on the electrode during operation. The quantity of getter required for those purposes may be called the corrective portion and it may be determined as follows, wherein M stands for the getter metal and n for its valance.

The iodine released during manufacture forms $HgI_2$ and the quantity thereof in the lamp envelope is measured. The quantity of getter M' needed to react therewith must satisfy the reaction:

$$HgI_2+(2/n)M \rightarrow Hg+(2/n)MI_n$$

and is given by $M'=(2/n)HgI_2$ (gram-atoms).

The quantity of getter needed to react with the iodine released by decomposition of the known charge of $ThI_4$ on the electrode must satisfy the reaction:

$$ThI_4+(4/n)M \rightarrow Th+(4/n)MI_n$$

and is given by $M''=4/nThI_4$ (gram-atoms).

The corrective getter portion will be the sum $M'+M''$.

In the second lamp making process previously mentioned in which the dose comprises mercury, $HgI_2$, NaI, and scandium and thorium in elemental form, the quantity of iodine may be made substoichiometric by precisely the quantity of thorium present. In such case no corrective getter corresponding to $M'+M''$ need be added.

If in lamps made by the first process one adds only the corrective getter portion corresponding to $M'+M''$, or in lamps made by the second process one adds no getter, the lamp's performance will be good initially but it will fall off relatively rapidly as the lamp ages. In order to have the desired improvement throughout the life of the lamp, in accordance with our invention we add what may be called a buffering getter portion. The buffering portion provides a buffering capacity or reserve margin to take care of any iodine released during life as a result of reaction of the dose with the fused silica envelope. The quantity of getter desirable for long-term buffering should be at least the stoichiometric equivalent of the thorium in the dose. We prefer to add about 2 times the stoichiometric equivalent; the amount is not critical, and in the case of cadmium or zinc, a substantial excess will do no worse than lower the efficacy slightly. At the same time it will lower the color temperature which, depending upon the projected application of the lamp, may be desirable.

ILLUSTRATIVE EXAMPLE #1

Figure 2:
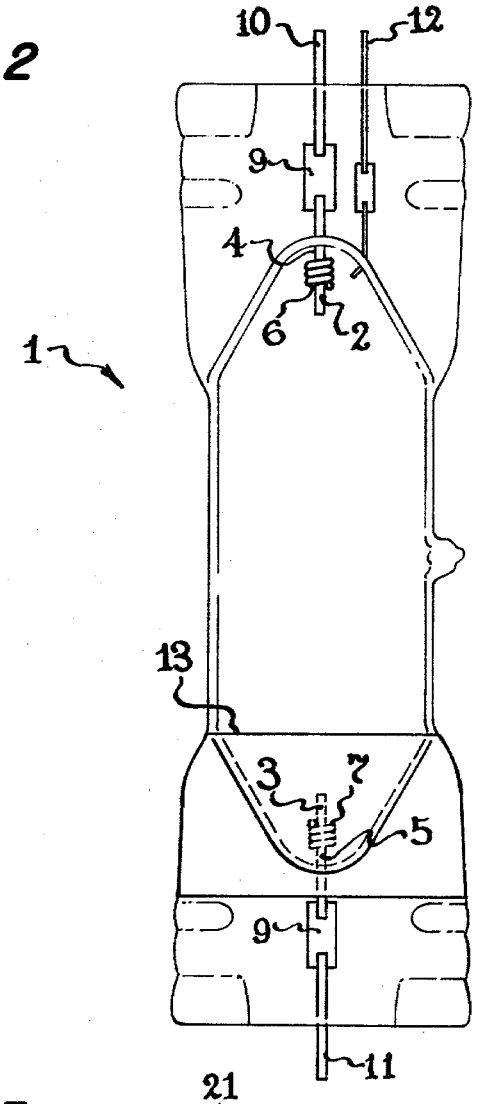
FIG. 2 is an elevational view of a metal halide arc discharge lamp in accordance with this invention.

The arc tube 1 of a high intensity discharge lamp in which the invention may be embodied is shown in FIG. 2. It is a 400-watt size intended for a.c. operation, and such arc tube is normally enclosed in an outer jacket shielding it from the atmosphere. It is made of fused silica $SiO_2$, that is quartz or quartz-like glass of known kind. Sealed in the arc tube at opposite ends are main discharge electrodes 2,3 supported by inleads 4,5 respectively. Each main electrode comprises a rod or shank portion which may be a prolongation of wires 4,5 and consisting of a suitable electrode metal such as tungsten or molybdenum but preferably the former. The rod portions are surrounded by wire helices 6,7 of the same material. An auxiliary starting electrode 8, also preferably of tungsten, is provided at one end of the arc tube adjacent main electrode 3 and comprises the inwardly projecting end of another inlead wire. Each inlead wire includes a molybdenum ribbon portion 9 which is completely embedded within the press seal end of the arc tube. The externally projecting lead-in wire portions 10 to 12 which serve to convey current to the electrodes are usually made of molybdenum and may be of one piece with the ribbon portions.

The arc tube is provided with an ionizable radiation generating filling comprising mercury, sodium iodide, scandium iodide, thorium iodide, and an inert rare gas such as argon to facilitate starting. The triple metal halide portion of the charge may be introduced in the form of high purity pellets of controlled size which have been protected against atmospheric contamination. U.S. Pat. No. 3,676,534—Anderson, "Process Relating to Ultra-pure Metal Halide Particles," 1972, describes one technique for preparing such materials for use in lamp making. The lower end of the discharge chamber (or both ends in the case of a universal burning lamp) may be coated with a white heat-reflecting coating 13 to assure adequate vaporization of the charge or filling.

The internal dimensions of the arc chamber are 20 mm diameter, and 63 mm length; the changer volume is 14 cc and the electrode gap is 45 mm. The dose comprises 60 mg of mercury and from 40 to 50 mg of the triple halide pellets which contain 10 to 15 weight percent $ScI_3$, 1.0 to 4 wt% $ThI_4$, and the balance NaI. In one series of lamps, the weight of $ThI_4$ in the charge was $8.35\times10^{-4}$ g which, at 740 g/mole, makes $1.13\times10^{-6}$ moles of $ThI_4$. The quantity M'' of Cd metal required to react with the iodine therein is $2.26\times10^{-6}$ g. atoms.

After the lamp had been processed, the quantity of $HgI_2$ measured in it was approximately 0.25 mg. At 454 g/mole, this makes $5.5\times10^{-7}$ moles, and the quantity of M' of Cd metal required to react therewith is $5.5\times10^{-7}$ gram atoms. Thus the minimum amount of cadmium required per the criteria of our invention is $M'+M''=2.81\times10^{-6}$ g atoms of Cd. Relative to the mercury charge of 60 mg which, at 200.6 g/mole for Hg, corresponds to $3\times10^{-4}$ g atoms, the minimum Cd getter addition per our criteria is approximately 1 atom percent of the mercury charge.

We have made and tested lamps corresponding to the above-described series, which have a nominal 100 hour lumen output of 34,000 lumens. Some lamps were made without getter to serve as standard, and others with Cd getter in amounts corresponding to 2 atom % and to 3 atom % of the Hg charge. The increment in lumen output referenced to the lamp without getter and expressed as a percentage, is given in Table 1 below. The improved maintenance achieved by the Cd getter additions over the measured time interval is apparent and ongoing tests indicate that it will continue at a comparable rate to the end of life.

TABLE 1

| Lamp | 500 hr. | 1000 hr. |
|---|---|---|
| 2 atom % Cd | +19% | +24% |
| 3 atom % Cd | +23% | +28% |

ILLUSTRATIVE EXAMPLE #2

Figure 3:
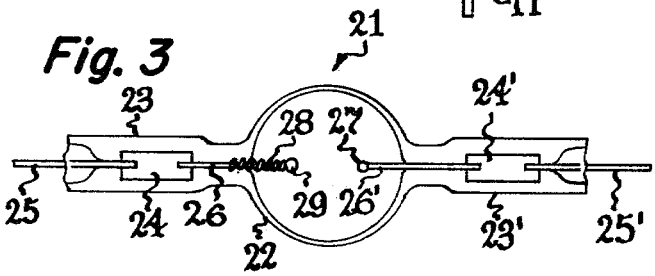
FIG. 3 shows a miniature metal halide arc lamp in which the invention may be embodied.

The invention is equally useful in the new miniature metal halide lamps disclosed in U.S. Pat. No. 4,161,672—Cap and Lake, July 1979. The arc tube 21 of such a lamp is shown in FIG. 3; it is made of quartz or fused silica and comprises a central bulb portion 22 which may be formed by the expansion of quartz tubing, and neck portions 23,23' formed by collapsing or vacuum sealing the tubing upon molybdenum foil portions 24,24' of electrode inlead assemblies. The discharge chamber or bulb is less than 1 cc in volume. Leads 25,25' welded to the foils project externally of the necks while electrode shanks 26,26' welded to the opposite sides of the foils extend through the necks into the bulb portion. The lamp is intended for unidirectional current operation and the shank 26' terminated by a balled end 27 suffices for an anode. The cathode comprises a hollow tungsten helix 28 spudded on the end of shank 26 and terminating at its distal end in a mass or cap 29 which may be formed by melting back a few turns of the helix.

A suitable filling for the envelope comprises argon or other inert gas at a pressure of several tens of torr to serve as starting gas, and a charge comprising mercury and the metal halides NaI, $ScI_3$ and $ThI_4$. A typical charge comprises 3.5 mg Hg and the metal halides include $3.12\times10^{-4}$ g $ThI_4$ which, at 740 g/mole, makes $4.22\times10^{-7}$ moles $ThI_4$. The quantity M'' of Cd required to react with iodine releasable therefrom is $8.43\times10^{-7}$ g atoms. The quantity of $HgI_2$ measured in the lamp after processing was approximately 0.1 mg. of $2.2\times10^{-7}$ moles, and the quantity M' of Cd metal required to react therewith is $2.2\times10^{-7}$ g atoms. Thus the minimum amount of cadmium getter required per the criteria which we have established is $M'+M''=1.06\times10^{-6}$ g atoms. Relative to the mercury charge of 3.5 mg corresponding to $1.74\times10^{-5}$ g atoms, the minimum Cd addition per our criteria is approximately 6 atom percent of the mercury charge.

What we claim as new and desire to secure by Letters Patent of the United States is:

1. A high intensity metal halide arc discharge lamp comprising an envelope of fused silica, inleads sealed into said envelope and electrically connected to electrodes positioned to define an arc gap therein, at least one of said electrodes serving as cathode comprising a tungsten portion on which thorium may deposit and be continually renewed by a transport cycle involving iodine, said thorium serving as an electron emitter allowing said cathode to achieve the electron emission required for the current through said lamp at a lower temperature, a discharge sustaining filling in said envelope provided by inserting therein at manufacture a charge comprising mercury, NaI, $ScI_3$, $ThI_4$ and an inert starting gas, and a getter in said envelope selected from the metals Cd, Zn, or mixtures thereof, the quantity of said getter being at least sufficient to provide the stoichiometric equivalent M' of any iodine released in said envelope as a result of impurities picked up during manufacture plus the stoichiometric equivalent M'' of the iodine resulting from decomposition of the $ThI_4$ in said charge, and the quantity of said getter not exceeding approximately three times the stoichiometric equivalents M' plus M''.

* * * * *